US011090930B2

(12) United States Patent
Anderson et al.

(10) Patent No.: US 11,090,930 B2
(45) Date of Patent: Aug. 17, 2021

(54) FLUDIC DIE

(71) Applicant: HEWLETT-PACKARD DEVELOPMENT COMPANY, L.P., Spring, TX (US)

(72) Inventors: Daryl E Anderson, Corvallis, OR (US); James M Gardner, Corvallis, OR (US); Eric Martin, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/619,041

(22) PCT Filed: Jul. 13, 2017

(86) PCT No.: PCT/US2017/041835

§ 371 (c)(1),
(2) Date: Dec. 3, 2019

(87) PCT Pub. No.: WO2019/013792

PCT Pub. Date: Jan. 17, 2019

(65) Prior Publication Data

US 2020/0122457 A1 Apr. 23, 2020

(51) Int. Cl.

| | |
|---|---|
| ***B41J 2/045*** | (2006.01) |
| ***B41J 2/14*** | (2006.01) |
| ***B41J 2/175*** | (2006.01) |

(52) U.S. Cl.

CPC ..... *B41J 2/0457* (2013.01); *B41J 2/0458* (2013.01); *B41J 2/14* (2013.01); *B41J 2/17596* (2013.01); *B41J 2002/14491* (2013.01)

(58) Field of Classification Search

CPC ..... B41J 2/04543; B41J 2002/14491
See application file for complete search history.

(56) References Cited

U.S. PATENT DOCUMENTS

| | | | | |
|---|---|---|---|---|
| 7,448,730 | B2 * | 11/2008 | Hirayama | B41J 2/04541 347/12 |
| 7,494,209 | B2 | 2/2009 | Bibl et al. | |
| 8,057,003 | B2 | 11/2011 | Hasenbein et al. | |
| 8,162,466 | B2 | 4/2012 | Bibl et al. | |
| 8,727,471 | B2 | 5/2014 | Ottosson et al. | |
| 9,403,372 | B2 | 8/2016 | Taff et al. | |
| 2014/0204148 | A1 | 7/2014 | Ge | |

FOREIGN PATENT DOCUMENTS

| | | |
|---|---|---|
| CN | 202818710 | 3/2013 |
| CN | 205509141 | 8/2016 |
| CN | 106657834 | 5/2017 |
| EP | 779151 | 7/2003 |

OTHER PUBLICATIONS

XAAR Innovative Inkjet Technology, 2016. < http://www.xaar.com/en/technology >.

* cited by examiner

*Primary Examiner* — Julian D Huffman
(74) *Attorney, Agent, or Firm* — Rathe Lindenbaum LLP

(57) ABSTRACT

A fluidic die may include an array of fluid actuators comprising a first set of fluid actuators and a second set of fluid actuators. The fluidic die may further include a first power line connected to the first set of fluid actuators, a second power line connected to the second set of fluid actuators and a third power line connected to the first set of fluid actuators.

20 Claims, 11 Drawing Sheets

FLUDIC DIE

BACKGROUND

Fluidic dies may control movement and ejection of fluid. Such fluidic dies may include fluid actuators that may be actuated to thereby cause displacement of fluid. Some example fluidic dies may be printheads, where the fluid may correspond to ink.

Figure 2:
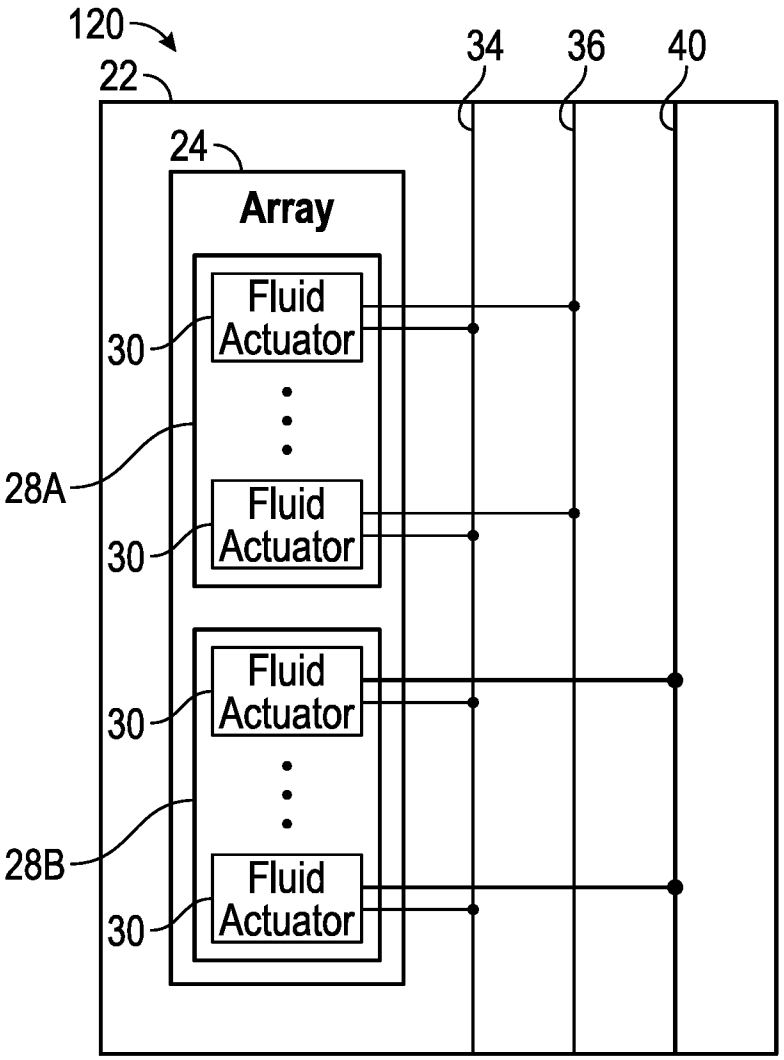
FIG. 2 is a schematic diagram illustrating portions of another example fluidic die.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Fluid actuators may be used to displace fluid on a fluidic die. Such fluid actuators may form a fluid pump or may form a fluid ejector. The fluid actuators may include a piezoelectric membrane based actuator, a thermal resistor based actuator, an electrostatic membrane actuator, a mechanical/impact driven membrane actuator, a magneto-strictive drive actuator, or other such elements that may cause displacement of fluid responsive to electrical actuation. Fluidic dies described herein may comprise a plurality of fluid actuators, which may be referred to as an array of fluid actuators.

Some example fluidic dies comprise microfluidic channels. Microfluidic channels may be formed by performing etching, microfabrication (e.g., photolithography), micromachining processes, or any combination thereof in a substrate of the fluidic die. Some example substrates may include silicon based substrates, glass based substrates, gallium arsenide based substrates, and/or other such suitable types of substrates for microfabricated devices and structures. Accordingly, microfluidic channels, chambers, orifices, and/or other such features may be defined by surfaces fabricated in the substrate of a fluidic die. Furthermore, as used herein a microfluidic channel may correspond to a channel of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.). Example fluidic dies described herein may comprise microfluidic channels in which fluidic actuators may be disposed. In such implementations, actuation of a fluid actuator disposed in a microfluidic channel may generate fluid displacement in the microfluidic channel. Accordingly, a fluid actuator disposed in a microfluidic channel may be referred to as a fluid pump. Example fluidic dies disclosed herein may comprise a chamber adjacent a nozzle through which fluid is ejected. In such an implementation, actuation of the fluid actuator disposed in the chamber may generate fluid displacement such that the fluid is ejected through the nozzle.

The example fluidic dies disclosed herein may comprise fluid ejection dies that facilitate the selective ejection of fluid. In one implementation, the example fluidic dies may comprise printheads for a printing device. Such a printing device may print two-dimensional images on print media, wherein the fluid ejection die ejects fluid contained in a reservoir and were in the fluid may comprise ink, toner, varnish, gloss, a fixing agent or the like. Such a printing device may print three-dimensional objects, such as with a 3-D printer or additive manufacturing device. In some implementations, the fluid ejection dies may form part of a print cartridge. In yet other implementations, a plurality of such fluid ejection dies may form a page-wide device that is to span and print across a width of a print medium.

The fluid actuators of fluidic dies are supplied with electrical power by power lines in the form of electrically conductive lines on the fluidic die. Such electrically conductive lines may be in the form of wires or traces. Such power lines may comprise power supply lines which electrically connect a power source to the fluid actuator or power ground lines or power return lines that electrically connect the fluid actuator to ground.

The power lines on the fluidic die that are connected to the fluid actuators may experience power line parasitics. Power line parasitics create current and voltage variations. Such current and voltage variations may lead to variations in the fluid displacement characteristics of the fluid actuators. Different types of fluid actuators or fluid actuators that displace different types of fluid may have different levels of sensitivity with respect to current and voltage variations brought on by power line parasitics.

Disclosed herein are example fluidic dies that utilize different power lines for different sets of fluid actuators on the fluidic die based upon the different levels of sensitivity that the different sets the fluid actors have with respect to current and voltage variations brought on by power line parasitics. Disclosed herein are example fluidic dies that utilize wider power lines for those sets of fluid actuators that are more sensitive to current and voltage variations brought on by power line parasitics and that utilize narrower power lines for those sets of fluid actuators that are less sensitive to current and voltage variations brought on by power line parasitics. The narrower power lines conserve valuable space on the fluidic die which may be utilized to provide more compact fluidic dies, to provide additional electronic componentry on the fluidic die and/or to increase the width of the other power lines to reduce power line parasitics for those fluid actuators that are more sensitive to current and voltage variations.

In some implementations, the "wider" power lines are physically wider. In other implementations, the "wider" power lines may not be physically wider, but are wider per unit of current. For example, the ratio of width per unit of current flow may be higher for those fluid actuators that are more sensitive to parasitic variation in that variations in the performance of such fluid actuators may have a greater impact on the performance of the overall system in which the fluid actuators are utilized.

For example, a high drop weight (HDW) fluid actuator may consume 20 mA of current. A lower drop weight (LBW) fluid actuator may consume 10 mA of current, this is fundamental because less energy is required to eject a smaller drop. In one implementation, the high drop weight fluid actuator would be given a power line 2× wider if we wanted the parasitic change equal between the two nozzle types (V=I*R). By way of example, the HDW nozzle power line is 100 um, and the LDW power line is 50 um. In circumstances where the low drop weight nozzle is more sensitive to parasitic variation, the "width" of the LBW power line may be increased to 70 um. Although 70 um is still physically narrower than 100 um, the ratio of width to current flow is larger to reduce power line parasitics.

Disclosed herein are example fluidic dies that selectively connect or electrically short the same types of power lines that are connected to the different sets of fluid actuators to further reduce power line parasitics. In some implementations, the same type of power lines, power supply lines or power ground lines, are electrically connected to one another (shorted) based upon voltage levels of the same type of power lines. For example, in one implementation, two power lines of the same type (supply or ground) connected to the two different sets of fluid actuators may be automatically electrically shorted in response to one of the power lines being underutilized and having a voltage less than or equal to a predetermined threshold voltage. In one implementation, a diode electrically connects the two power lines so as to automatically electrically short the two power lines of the same type based upon the voltage levels of the two power lines. In another implementation, an electrical switch, such as a transistor, electrically connects the two power lines of the same type, wherein the voltage levels of the two power lines are sensed and utilized to automatically open or close the switch to automatically electrically short the two power lines of the same type. In one implementation, the voltage levels of the two power lines are sensed. In another implementation, the voltage levels of the two power lines may be calculated by the controller for a given firing condition. In some implementations, the switch/transistor may be controlled by other circuits based on factors involving specific power conditions that are desired for a given actuation condition.

In some implementations, each set of fluid actuators of an array has a dedicated power supply line and a dedicated power ground line. In some implementations, the dedicated power ground lines of the two sets of fluid actuators are automatically electrically connected or shorted based upon a voltage level of the power ground lines. In some implementations, the dedicated power supply lines of the two sets of fluid actuators are automatically electrically connected or shorted based upon a voltage level of the power supply lines. In some implementations, the different sets of fluid actuators of an array share a power ground line, but have dedicated separate power supply lines. In yet other implementations, the different sets of fluid actuators of an array share a power supply line, but have dedicated separate power ground lines.

In one implementation, the different sets of fluid actuators of an array have actuators that are similar to one another except that the actuators of the different sets displace different fluids. For example, in one implementation, a first set of fluid actuators may form fluid ejectors for a first type of ink, such as a yellow ink, while the other set of fluid actors may form fluid ejectors for a second type of ink having a different color such as cyan, magenta or black ink. In such an implementation, print quality or image quality may be less sensitive to variations in the ejection of yellow ink as compared to the ejection of other colors of ink. In such an implementation, those fluid actuators that form ejectors for ejecting yellow ink may be provided with narrower power lines (power supply and/or power ground lines) as compared to those fluid actuators that form ejectors for ejecting other colors of ink.

In some implementations, the different sets of fluid actuators themselves may have different characteristics that serve as a basis for varying the characteristics of the power lines connected to the different sets of fluid actuators. For example, in one implementation, a first set of fluid actuators may form fluid ejectors for ejecting a first drop weight of fluid while the second set of fluid actuators may form fluid ejectors for ejecting a second drop weight of fluid, wherein print quality or image quality may be more sensitive to variations in the ejection of fluid at a smaller drop weight as compared to the ejection of fluid at a larger drop weight. In such an implementation, those fluid actuators that form ejectors for ejecting the smaller drop weight may be provided with wider power lines (wider per unit of current) as compared to those fluid actuators that form ejectors for ejecting larger drop weights.

In some implementations, the different sets of fluid actuators may displace fluid in different fashions. For example, in one implementation, the different sets of fluid actuators may comprise a first set of fluid actuators that form fluid ejectors and a second set of fluid actuators that form fluid pumps. In some implementations, performance of the fluidic die may be more sensitive to variations in the power supplied to the fluid actuators forming the fluid ejectors as compared to the fluid actuators forming the fluid pumps. In such an implementation, those fluid actuators of an array that form fluid ejectors may be provided with wider dedicated power lines (wider power supply lines and/or power ground lines) as compared to those fluid actuators of the array that form fluid pumps. The wider power lines provide those fluid actuators that form the fluid ejectors with lower levels of power parasitics and lesser variations in electrical current and voltage to provide enhanced performance of the fluidic die.

Disclosed herein is an example fluidic die that may comprise an array of fluid actuators comprising a first set of fluid actuators and a second set of fluid actuators. The fluidic die may further include a first power line connected to the first set of fluid actuators, a second power line connected to the second set of fluid actuators and a third power line connected to the first set of fluid actuators.

Disclosed herein is an example method for supplying power to fluid actuators on a fluidic die. The method may comprise supplying power to the first set of fluid actuators across a first power supply line dedicated to the first set of fluid actuators, supplying power to the second set of fluid actuators across a second power supply line dedicated to the second fluid actuators, returning electrical current from the first set of fluid actuators across a first power ground line dedicated to the first set of fluid actuators and returning electrical current from the second set of fluid actuators across a second power ground line dedicated to the second set of fluid actuators.

Disclosed herein is an example fluidic die that may comprise an array of fluid ejectors and fluid pumps, each of the fluid ejectors and the fluid pumps comprising a fluid actuator, a first power supply line connected to the fluid actuator of each of the fluid ejectors of the array, a second power supply line connected to the fluid actuator of each of the fluid pumps of the array. The first power supply line and the second power supply line may combine outside of the array. A first power ground line may be connected to each of the fluid actuators of the fluid ejectors of the array while a second power ground line is connected to each of the fluid actuators of the fluid pumps of the array. The first power ground line and the second power ground line may combine outside of the array. A diode may be electrically connected between the first power ground line and the second power ground line.

Figure 1:
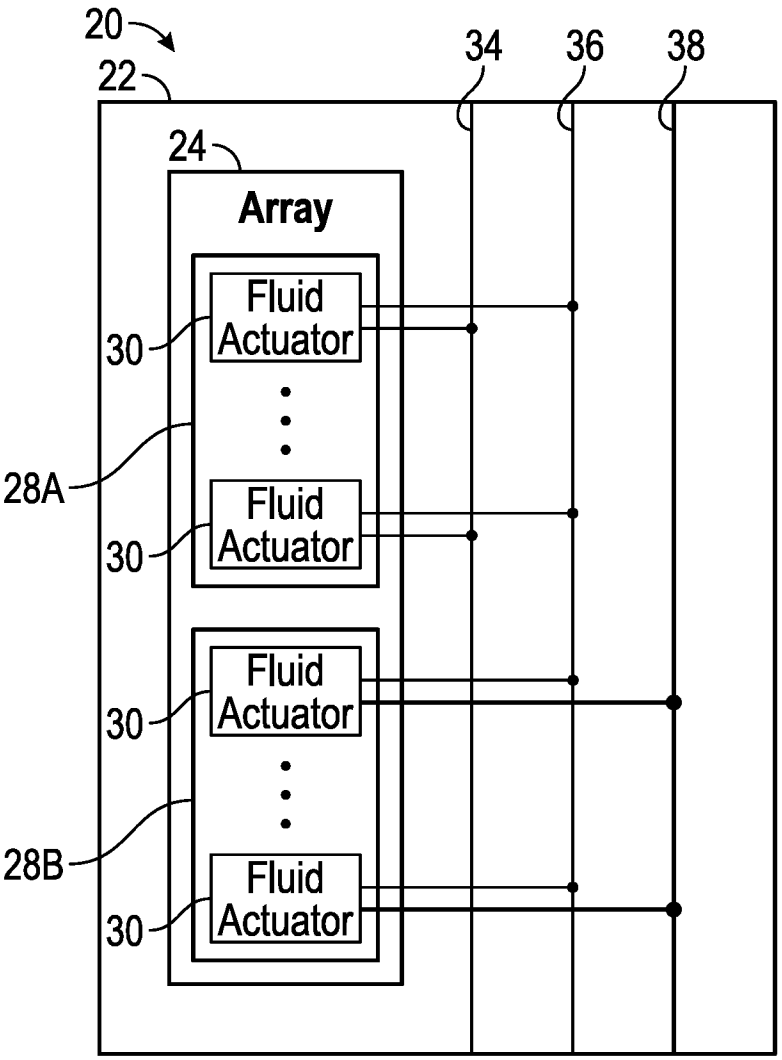
FIG. 1 is a schematic diagram illustrating portions of an example fluidic die.

FIG. 1 is a schematic diagram illustrating portions of an example fluidic die 20. Fluidic die 20 utilizes different power lines for different sets of fluid actuators on the fluidic die based upon the different levels of sensitivity that the different sets the fluid actuators have with respect to current and voltage variations brought on by power line parasitics. In the example illustrated, fluidic die 20 comprises a substrate 22 supporting an array 24 of fluid actuators 30. Array 24 comprises sets 28A and 28B of fluid actuators 30 (collectively referred to as sets 28). Although the fluid actuators 30 of each of sets 28A and 28B are illustrated as being consecutive, grouped into a cluster apart from the fluid actuators of the other set 28, the fluid actuators 30 of each of sets 28 may, in some implementations, be interspersed with one another. For example, the fluid actuators of set 28A may be mixed amongst the fluid actuators of sets 28B.

The use of fluid actuators of sets 28A and 28B have different degrees of sensitivity to variations in electrical power or current brought on by power line parasitics. The different degrees of sensitivity may be the result of different constructions of the fluid actuators 30 of the different sets 28, different operating parameters of fluid actuators 30 of the different sets 28, different surrounding architectures of the fluid actuators 30 of the different sets 28 or differences in the characteristics of the fluid being displaced by the different fluid actuators 30 of the different sets 28. In one implementation, fluid actuators 30 of set 28A each form fluid ejectors while fluid actuators 30 of set 28B each form fluid pumps. Image quality or other performance metrics may be more sensitive are dependent upon the ejection of fluid by fluid actuators 30 of set 28A as compared to the pumping or circulation of fluid by fluid actuators 30 of set 28B. In another implementation, fluid actuators 30 of both sets 28 form fluid ejectors, wherein the fluid actuators 30 of set 28A eject fluid at a first drop weight of the fluid actuators 30 of set 28B eject fluid at a second drop weight different than the first drop weight.

In one implementation, fluid actuators 30 of both sets 28 form fluid ejectors, wherein the fluid actuators 30 of set 28A eject a first fluid having a first characteristic while fluid actuators 30 of set 28B eject a second fluid having a second characteristic different than the first characteristic. For example, in one implementation, fluid actuators 30 of set 28A may be fluidically connected to a source of yellow ink whereas fluid actuators 30 of set 28B are fluidically connected to a different color of ink, such as cyan, magenta or yellow. In such an implementation, color image quality may be less sensitive to fluctuations in yellow as compared to other colors, resulting in the use of fluid actuators 30 of set 28A having a lesser degree of sensitivity to variations in electrical power or current brought on by power line parasitics.

In one implementation, fluid actuators 30 of each of sets 28 form a group of fluid actuators referred to as a primitive. A primitive generally comprises a group of fluid actuators that each have a unique actuation address. In some examples, electrical and fluidic constraints of a fluidic die may limit which fluid actuators of each primitive may be actuated concurrently for a given actuation event. Therefore, primitives facilitate addressing and subsequent actuation of fluid ejector subsets that may be concurrently actuated for a given actuation event.

To illustrate by way of example, if a fluidic die comprises four primitives, where each respective primitive comprises eight respective fluid actuators (each eight fluid actuator group having an address 0 to 7), and electrical and fluidic constraints limit actuation to one fluid actuator per primitive, a total of four fluid actuators (one from each primitive) may be concurrently actuated for a given actuation event. For example, for a first actuation event, the respective fluid actuator of each primitive having an address of 0 may be actuated. For a second actuation event, the respective fluid actuator of each primitive having an address of 1 may be actuated. As will be appreciated, the example is provided merely for illustration purposes. Fluidic dies contemplated herein may comprise more or less fluid actuators per primitive and more or less primitives per die.

In the illustrated example, sets 28 of fluid actuators 30 are supported upon a single substrate 22, forming a single fluidic die. In other implementations, sets 28 of fluid actuators 30 maybe supported on separate and distinct substrates 22 such as where set 28A is on a first fluidic while set 28B is on a second fluidic die. In another implementation, sets 28A and 28B may be dispersed or distributed amongst multiple fluidic dies such as where a first fluidic die supports portions of each of sets 28 and a second fluidic die supports portions of each of sets 28.

Fluid actuators 30 of sets 28 are powered with electrical power by power lines comprising power lines 34, 36 and 38. Power lines comprise electrically conductive lines on the fluidic die. Such electrically conductive lines may be in the form of wires or traces. For purposes of this disclosure, a "power line" may refer to a power supply line or a power ground line. Power supply lines electrically connect a power source to the fluid actuator. Power ground lines (also referred to as power return lines) electrically connect the fluid actuator to ground.

FIG. 1 illustrates an example fluidic die wherein the fluid actuators 30 of the different sets 28 have dedicated power supply lines 34, 38 but share a common power ground line 36. In such an implementation, those power supply lines before, 38 connected to the set 28 of fluid actuators 30 that are most sensitive to power variations brought on by power line parasitics may be provided with a first width while those power supply lines 34, 38 connected to the set 28 of fluid actuators 30 that are least sensitive to power variations brought on by power line parasitics may be provided with a second width less than the first with. Those power supply lines having the larger width reduce power variations seen by those fluid actuators 30 of the set 28 having the greatest sensitivity to power variations brought on by power line parasitics.

FIG. 2 is a schematic diagram illustrating portions of another example fluidic die 120. Like fluidic die 20, fluidic die 120 utilizes different power lines for different sets of fluid actuators on the fluidic die based upon the different levels of sensitivity that the different sets the fluid actors have with respect to current and voltage variations brought on by power line parasitics. Fluidic die 120 is similar to fluidic die 20 except that the fluid actuators 30 of the different sets 28 have dedicated power return lines 36 and 40 but share a common power supply line 34. In such an implementation, those power ground lines 36, 40 connected to the set 28 of fluid actuators 30 that are most sensitive to power variations brought on by power line parasitics may be provided with a first width while those power ground lines 36, 40 connected to the set 28 of fluid actuators 30 that are least sensitive to power variations brought on by power line parasitics may be provided with a second width less than the first width. Those power ground lines having the larger width reduce power variations seen by those fluid actuators 30 of the set 28 having the greatest sensitivity to power variations brought on by power line parasitics.

Figure 3:
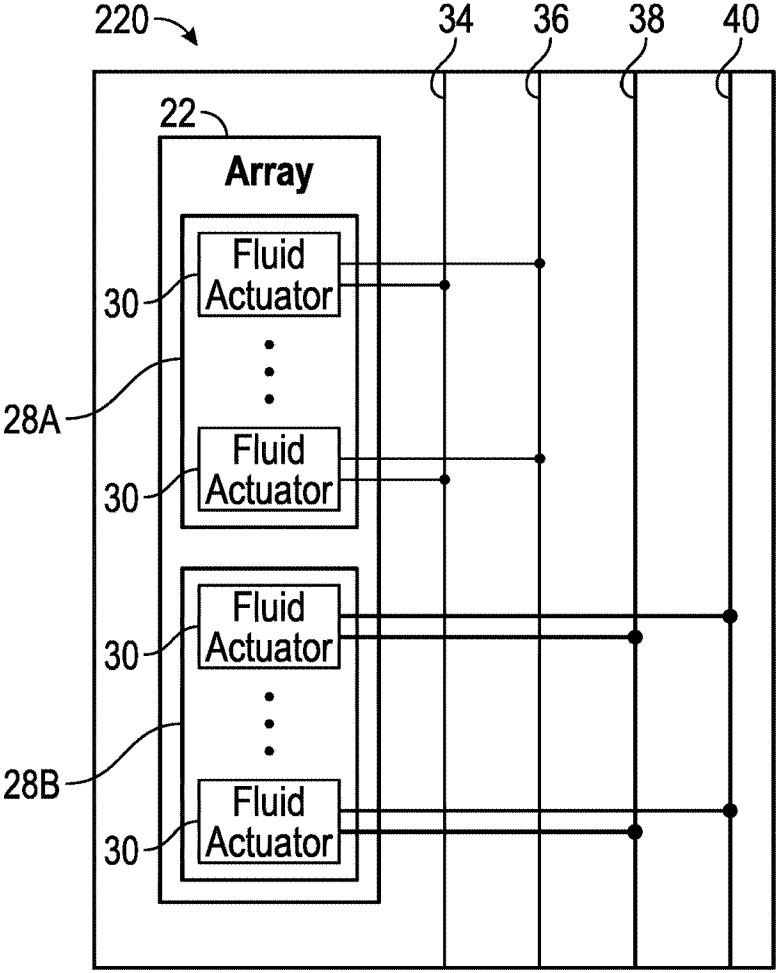
FIG. 3 is a schematic diagram illustrating portions of another example fluidic die.

FIG. 3 schematically illustrates portions of an example fluidic die 220. Fluidic die 220 is similar to fluidic die 120 described above except that fluidic die 220 has dedicated power supply lines and power return lines for the fluid actuators 30 of each of sets 28. As shown by FIG. 3, the fluid actuators 30 of set 28A are provided with electrical power for driving such fluid actuators 30 with power supply line 34 and power ground line 36. The fluid actuators 30 of set 28B are provided with electrical power for driving such fluid actuators 30 with power supply line 38 and power ground line 40. In the example illustrated, the use of fluid actuators 30 of sets 28B is more sensitive to variations in electrical current or electrical power resulting from power line parasitics. To address the enhanced power variation sensitivity of the fluid actuators 30 of sets 28B, each of the power lines 38, 40 connected to fluid actuators 30 of set 28B are provided with a wider width as compared to the width of the power lines 34, 36 connected to fluid actuators 30 of set 28A. As a result, fluid actuators 30 of set 28B may experience smaller power line parasitics and less power variations.

Although both of power lines 38, 40 are illustrated as being provided with wider widths as compared to power lines 34, 36, in other implementations, one of power lines 38, 40 may be provided with a wider width as compared to power lines 34, 36. For example, in one implementation, power ground line 40 may have a wider width as compared to each of power lines 34, 36 and 38. In some implementations, power supply line 38 may have a width greater than that of power lines 34, 36, but less than the width of power ground line 40. In yet other implementations, power supply line 38 may have a wider width as compared to each of power lines 34, 36 and 40. In some implementations, power ground line 40 may have a width greater than that of power lines 34, 36 but less than the width of power supply line 38.

In one implementation, fluid actuators 30 of set 28B form fluid ejectors while fluid actuators 30 of set 28A form fluid pumps. In one implementation, the fluid pumps formed by fluid actuators 30 of set 28A are interspersed amongst the fluid ejectors to move fluid into or through firing chambers of the fluid ejectors. In one implementation, the fluid actuators 30 of set 28B form fluid ejectors that are fluidically connected to a source of a first color of ink while the fluid actuators 30 of set 28B form fluid ejectors that are fluidically connected to a source of a second color of ink different than the first color. For example, in one implementation, the fluid actuators 30 of set 28B form fluid ejectors that are fluidly connected to a source of yellow ink while the fluid actuators 30 of set 28A form fluid ejectors that are fluidly connected to a source of another color of ink, such as cyan, magenta or black ink. In one implementation, the fluid actuators 30 of set 28B form fluid ejectors that are to eject a first drop weight of fluid while the fluid actuators 30 of set 28A form fluid ejectors that are to eject a second drop weight of fluid greater than the first drop weight of fluid.

Figure 4:
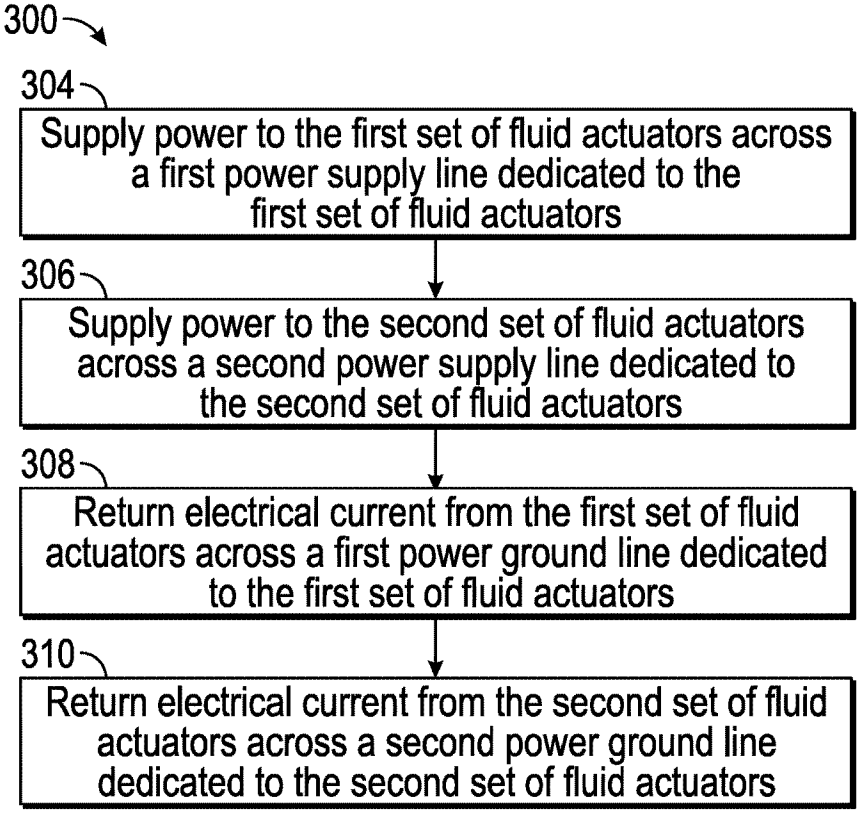
FIG. 4 is a flow diagram of an example method for supplying power to fluid actuators of an example fluidic die.

FIG. 4 is a flow diagram of an example method 300 for powering different sets of fluid actuators having different sensitivities to power variations caused by power line parasitics. As indicated by block 304, power is supplied to the first set of fluid actuators of an array across a first power supply line dedicated to the first set of fluid actuators. As indicated by block 306, power supplied to a second set of fluid actuators of the array across a second power supply line dedicated to the second set of fluid actuators. As indicated by block 308, electrical current is returned from the first set of fluid actuators across a first power ground line dedicated to the first set of fluid actuators. As indicated by block 310, electric current is returned from the second set of fluid actuators across a second power ground line dedicated to the second set of fluid actuators.

Figure 5:
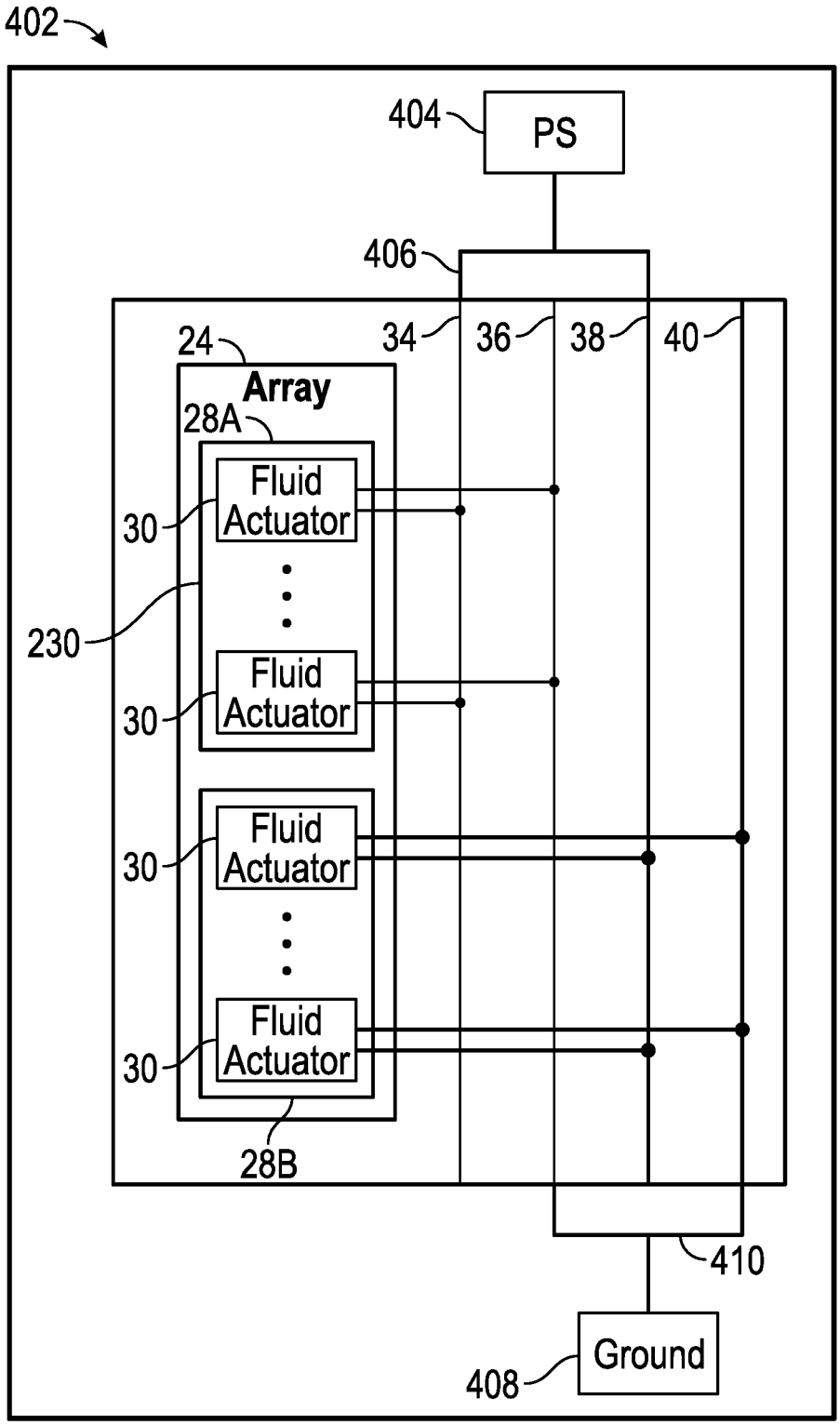
FIG. 5 is a schematic diagram illustrating portions of an example fluid displacement system.

FIG. 5 schematically illustrates portions of an example fluid displacement system 402. System 402 comprises fluidic die 230, power supply 404, off die power supply line 406, ground 408 and off die power ground line 410. Power supply 404 supplies power to the fluid actuators 30 on microfluidic die 230. Power supply 404 is located remote or off of die 230. Power supply 404 supplies electric current to power supply lines 34, 38 on die 230 across off die power supply line 406. Off die power supply line 406 comprises a single electrically conductive line extending from power supply 404, and the single-line branches off to the two separate power supply lines 34, 38 which, as described above, have different widths to accommodate the different sensitivities of the fluid actuators 30 of the different sets 28A and 28B to power variations caused by power line parasitics.

Ground 408 comprise a connection to ground that is located off of die 230. Ground 408 is connected to each of power ground lines 36, 40 by off die power ground line 410. Off die power ground line 410 comprises a single electrically conductive line extending from ground 408 and branching off to the two separate power ground lines 36, 40 which, as described above, have different widths to accommodate the different sensitivities of the fluid actuators 30 of the different sets 28A and 28B to power variations caused by power line parasitics.

Figure 6:
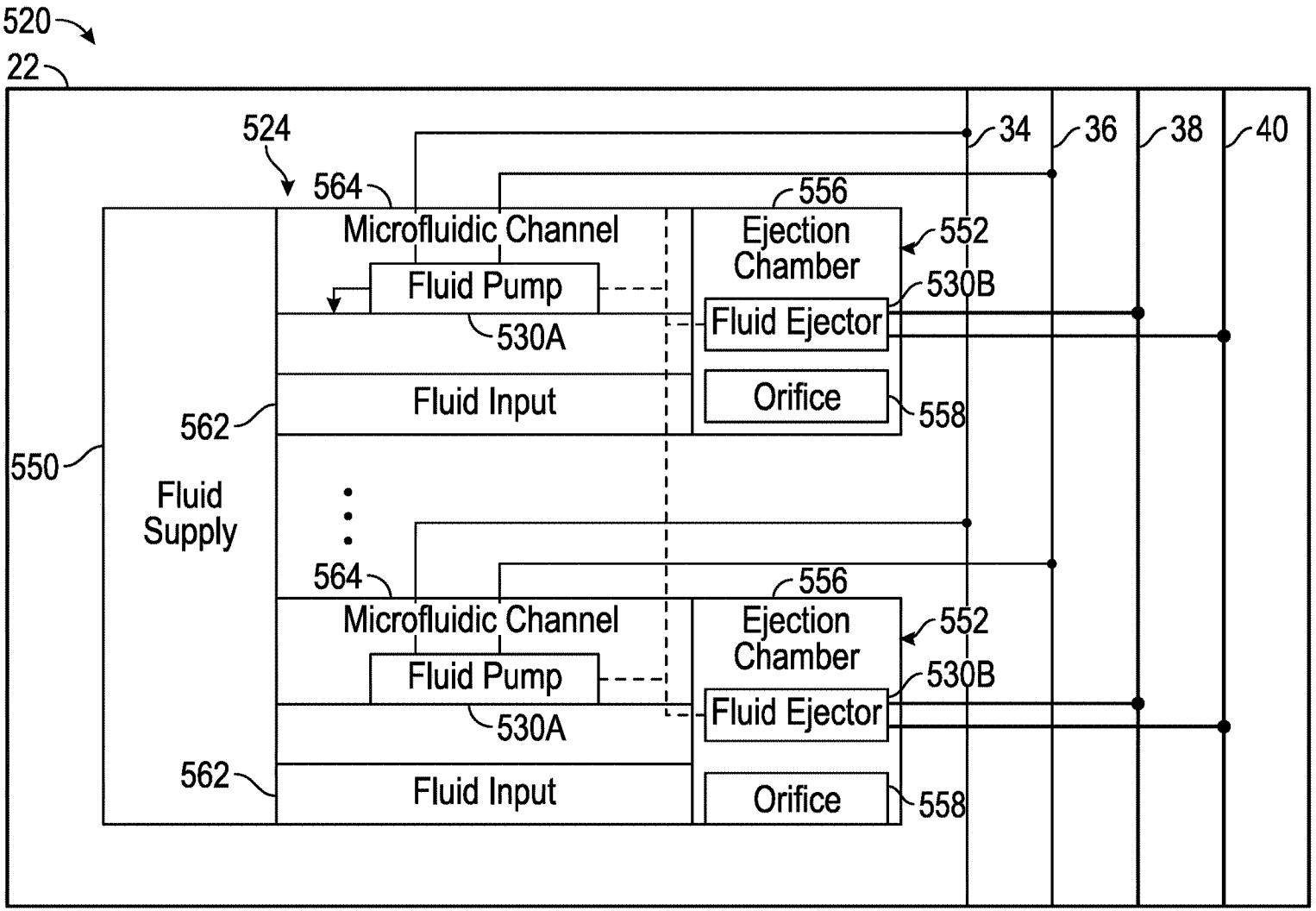
FIG. 6 is a schematic diagram illustrating portions of another example fluidic die.

FIG. 6 is a schematic diagram illustrating portions of an example fluidic die 520. Fluidic die 520 is similar to fluidic die 220 described above except that fluidic die 520 is specifically illustrated as comprising an array 524 of fluid actuators 530A that form fluid pumps and fluid actuators 530B that form fluid ejectors. Those components of fluidic die 520 which correspond to components of fluidic die 220 are numbered similarly. Fluid actuators 530A and fluid actuators 530B are paired along a fluid supply 550, wherein each of the fluid pumps formed by a fluid actuator 530A circulates fluid to and/or from an associated fluid actuator 530B forming a fluid ejector.

As further shown by FIG. 6, each fluid actuator 530B is part of a nozzle 552 having an ejection chamber 556 having an orifice 558 and in which the fluid actuator 530B is located. Each ejection chamber 556 is fluidly connected to fluid supply 550 by a fluid input 562 and a microfluidic channel 564. In the example illustrated, fluid input 562 and microfluidic channel 564 facilitate circulation of fluid into ejection chamber 556, through and across ejection chamber 556 and out of ejection chamber 556 back to fluid supply 550. In the example illustrated, such circulation is facilitated by fluid pumps formed by fluid actuator 530A within microfluidic channel 564.

In one implementation, fluid supply 550 comprises an elongated slot supplying fluid to each of the fluid actuators 530B of the array 524. In another implementation, fluid supply 550 may comprise an array of ink feed holes. In one implementation, fluid supply 550 further supplies fluid to fluid ejectors formed by fluid actuators 530B and fluid pumps formed by fluid actors 530A located on an opposite side of fluid supply 550.

Similar to fluidic dies 220 and 320 described above, fluidic die 520 has dedicated power supply lines and power return lines for the fluid actuators 30 of each of sets 28. As shown by FIG. 6, the fluid actuators 530A are provided with electrical power for driving such fluid actuators 530A with power supply line 34 and power ground line 36. The fluid actuators 530B are provided with electrical power for driving such fluid actuators 530B with power supply line 38 and power ground line 40. In the example illustrated, the performance of die 520 is more sensitive to the performance of fluid actuators 530B, the fluid ejectors, as compared to the performance of fluid actuators 53A, the fluid pumps. The ejection of fluid by die 520 by fluid actuators 530B is more sensitive to variations in electrical current or electrical power being supplied to fluid actuators 530B resulting from power line parasitics as compared to variations in electrical current or logical power being supplied of fluid actuators 530A resulting from power line parasitics. To address the enhanced power variation sensitivity of the fluid actuators 530B, each of the power lines 38, 40 connected to fluid actuators 530B provided with a wider width as compared to the width of the power lines 34, 36 connected to fluid actuators 530B. As a result, fluid actuators 530B may experience smaller power line parasitics and less power variations.

Although both of power lines 38, 40 are illustrated as being provided with wider widths as compared to power lines 34, 36, in other implementations, one of power lines 38, 40 may be provided with a wider width as compared to power lines 34, 36. For example, in one implementation, power ground line 40 may have a wider width as compared to each of power lines 34, 36 and 38. In some implementations, power supply line 38 may have a width greater than that of power lines 34, 36, but less than the width of power ground line 40. In yet other implementations, power supply line 38 may have a wider width as compared to each of power lines 34, 36 and 40. In some implementations, power ground line 40 may have a width greater than that of power lines 34, 36 but less than the width of power supply line 38.

Figure 7:
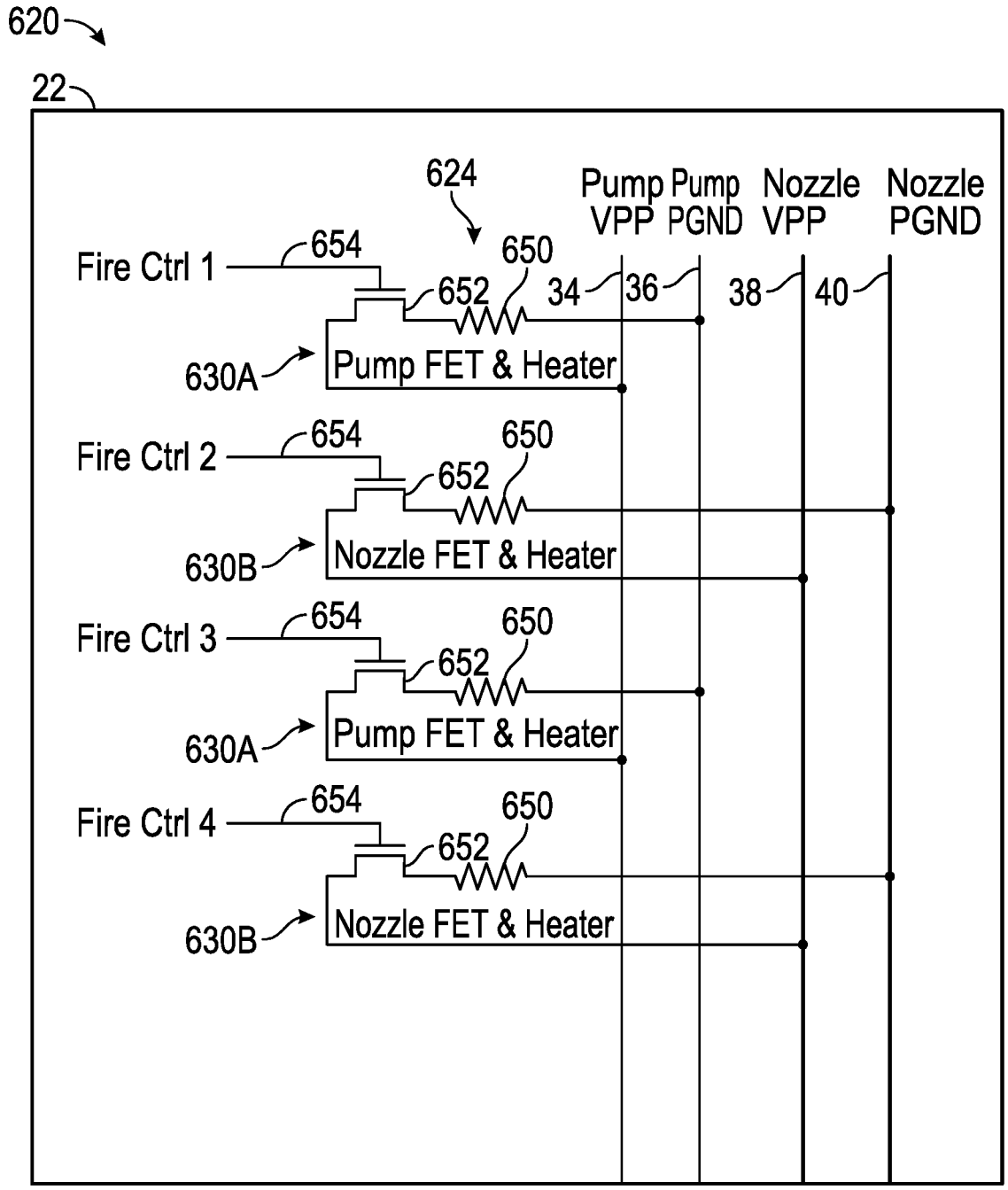
FIG. 7 is a schematic diagram illustrating portions of another example fluidic die.

FIG. 7 schematically illustrates portions of another example fluidic die 620. Fluidic die 620 is similar to fluidic die 520 in that fluidic die 620 comprises a substrate 22 supporting an array 624 of fluid actuators 630A, 630B (collectively referred to as fluid actuators 630) which form an alternating pattern of fluid pumps and fluid ejectors. Each of fluid actuators 630 comprises an electrically resistive element 650 and a transistor 652. Electrically resistive element 650 of each of fluid actuators 630A, forming a fluidic pump, is electrically connected to a power supply line 34 and a power ground line 36 which cooperate to supply electrical current across the electrically resistive element 650. Electrically resistive element 650 each of fluid actuators 630B is electrically connected to a power supply line 38 and a power ground line 40 which cooperate to supply electrical current across the electrically resistive element 650. As with fluidic die 520, power lines 38, 40 each have a width greater than that of power lines 34, 36, occupying more space on substrate 22, but reducing power delivery parasitics. As a result, performance of fluidic dye 520 is enhanced by reducing power delivery parasitics for the fluid actuators 530B of the fluid ejectors which are more sensitive to power delivery parasitics as compared to the fluid actuators 530A forming the fluid pumps.

In the example illustrated, each electrically resistive element 650 produces heat in response to the supply of electrical current by line 34 and 36. The heat produced by each of the electrically resistive elements 650 is sufficient enough to vaporize adjacent fluid, creating a bubble which displaces fluid, either along the microfluidic channel (such as microfluidic channel 564 described above) in the case of fluid actuators 630A or within an ejection chamber and through an orifice (such as ejection chamber 556 and orifice 558 described above) in the case of fluid actuators 630B. In other implementations, in lieu of forming thermal-resistive inertial pumps and fluid ejectors, the electrically resistive element 650 may be part of other designs for displacing fluid. For example, the electric resistive element 650 may comprise piezo-resistive elements that change shape in response to the application of electrical current, deforming a membrane to displace adjacent fluid.

Transistors 652 of each of fluid actuators 630 facilitate control over the actuation of fluid actuators 630. Each of transistor 652 has a gate electrically connected to a fire control line 654 signals transmitted the crossfire control line 654 selectively actuate the associated fluid actuator 630A, 630B. In the example illustrated, each of transistor 652 is electrically connected between the associated electrically resistive element 650 and the associated power supply line 34, 38, forming what may be referred to as a high side switch. In other implementations, each of fluid actuators 630 may be controlled through the use of a low side switch or a hybrid switch (as described below).

Figure 8:
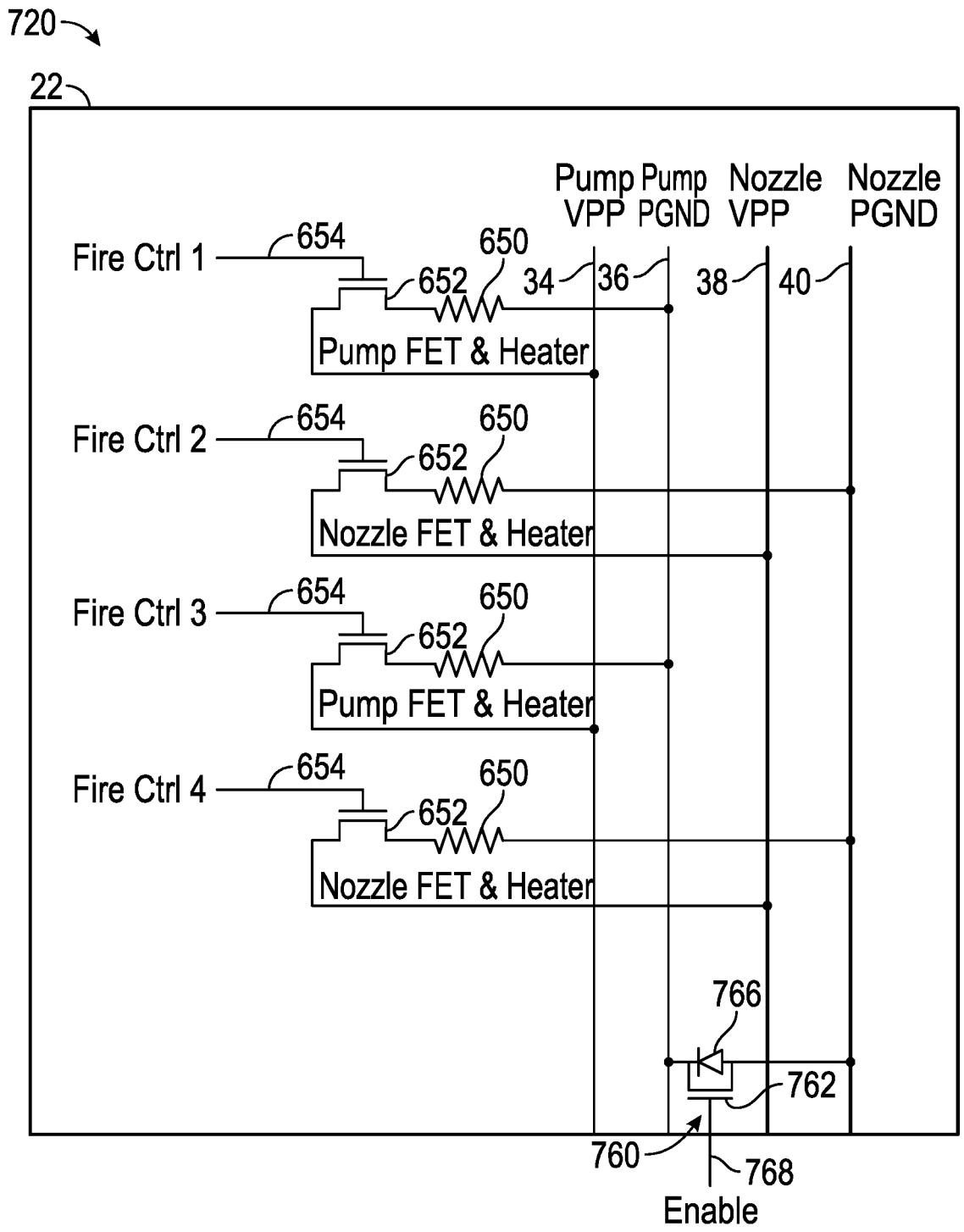
FIG. 8 schematic diagram illustrating portions of another example fluidic die.

FIG. 8 schematically illustrates portions of another example fluidic die 720. Die 720 is similar to die 620 except that die 720 additionally comprises the shorting switch 760. Those remaining components of die 720 which correspond to components of die 620 are numbered similarly.

Shorting switch 760 is electrically connected between power ground line 34 and power ground line 40. Shorting switch 760 selectively electrically shorts power ground lines 36 and 40 together in response to conditions where power ground line 36 is being underutilized. When power ground lines 36 and 40 are shorted together, electrically connected to one another, shorting switch 760 reduces parasitics for the power ground line 40 connected to the fluid ejectors that are more sensitive to power delivery parasitics. During higher use of power ground line 36, such as when the voltage of power ground line 36 is higher than the voltage of power ground line 40, shorting switch 760 maintains isolation of power ground line 36 from power ground line 40.

In the example illustrated, shorting switch 760 comprises transistor 762 and diode 766. Transistor 762 has a gate electrical connected to an enablement line 768 which communicates electrical signals opening and closing transistor 762 to selectively short or isolate power ground lines 36, 40 with respect to one another. In one implementation, enablement signals are transmitted across enablement line 768 by a controller based upon which fluid actuators 630 are to be actuated at a particular moment. In another implementation, enabling signals are transmitted across enable line 768 by controller based upon a sensed characteristic of power ground line 36, 40, such as a sensed voltage along power ground lines 36, 40 or based on expected conditions that at calculated, obtained from a lookup table or which are measured.

Diode 766 bypasses transistor 762, automatically shorts power ground lines 36, 40 in response to a voltage differential between power ground lines 36, 38 exceeding a predetermined diode voltage threshold. In one implementation, the predetermined diode voltage threshold may be 0.7 V, wherein diode 766 automatically shorts lines 36 and 40 when line 40 is 0.7 V above line 36. In other implementations, diode 766 may automatically short lines 36, 40 in response to other voltage differentials. In some implementations, diode 766 may be omitted.

Figure 9:
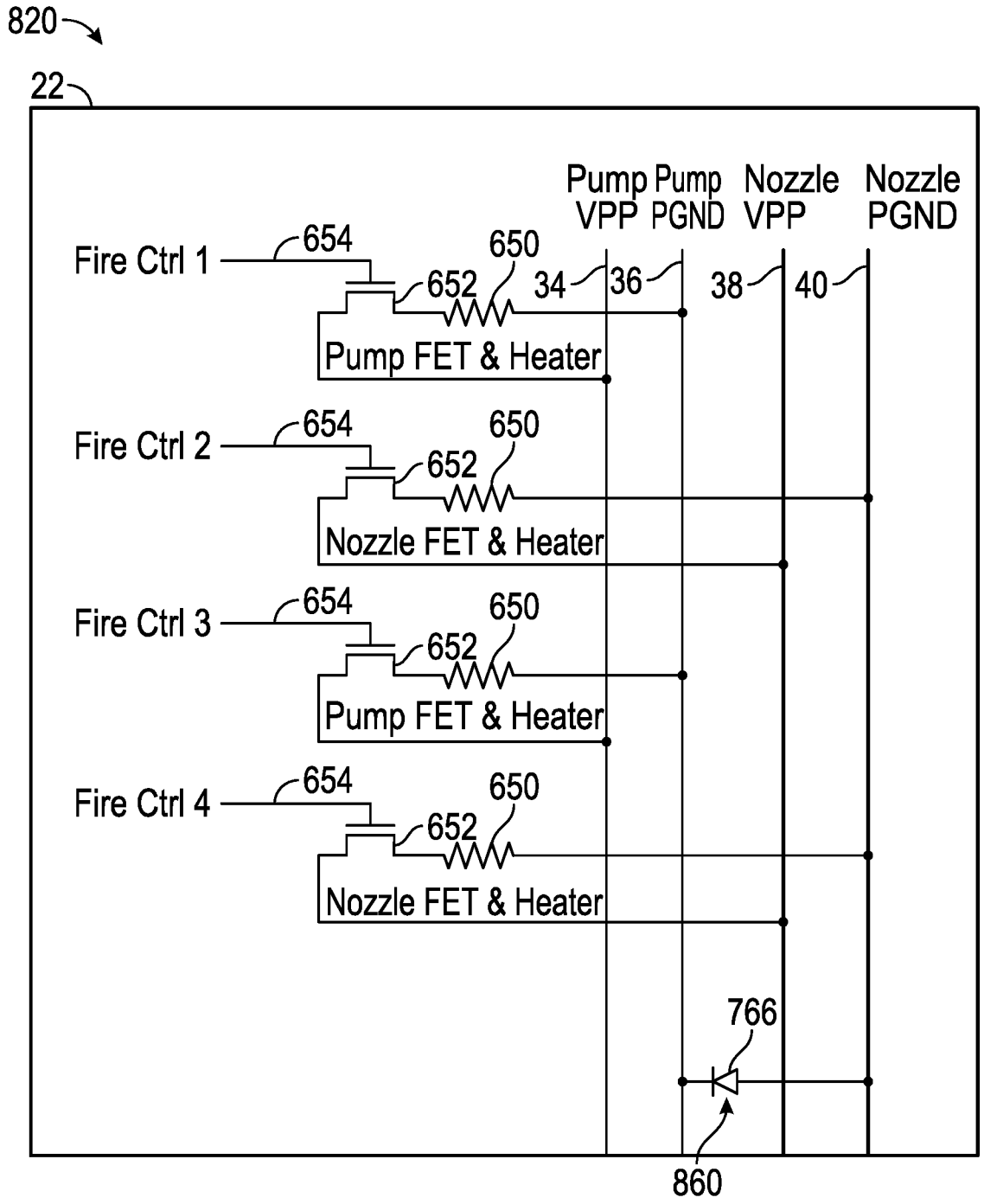
FIG. 9 is a schematic diagram illustrating portions of another example fluidic die.

FIG. 9 schematically illustrates portions of another example fluidic die 820. Fluidic die 820 similar to fluidic die 720 except that fluidic die 820 comprises a shorting switch 860 in the form of diode 766 (described above). Those remaining components of die 820 which correspond to components of die 720 are numbered similarly. Shorting switch 860 occupies minimal circuit area while providing a reduction of power delivery parasitics for fluid actuators 630B forming the fluid ejectors when the power ground line 36 associated with the fluid actuators 630A and forming the fluid pumps is being underutilized resulting in power ground line 40 voltage being greater than a diode threshold above power ground line 36 voltage.

Figure 10:
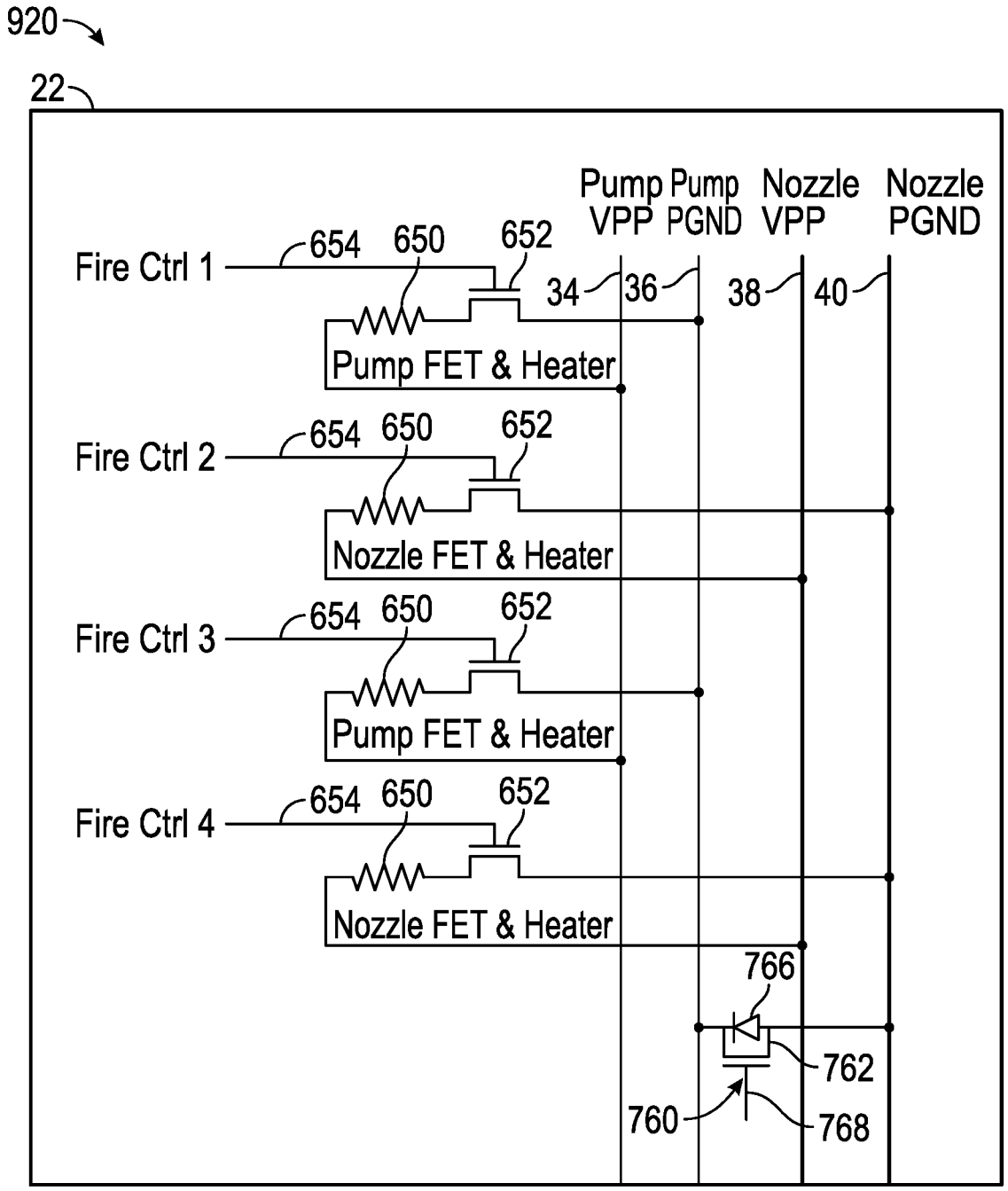
FIG. 10 is a schematic diagram of string portion of another example fluidic die.

FIG. 10 schematically illustrates portions of another example fluidic die 920. Fluidic die 920 is similar to fluidic die 720 described above except that transistors 652 form low side switches for their respective fluid actuators 630. Each of transistors 652 is electrically connected between the associated electrically resistive element 650 and the respective power ground line 36, 40. Although die 920 is illustrated as comprising shorting switch 760, in other implementations, die 920 may comprise shorting switch and 860. As with die 720, die 920 provides enhanced performance by: (1) reducing power delivery parasitics for the fluid ejectors which are more sensitive to such parasitics by providing dedicated power ground lines 40 for the fluid actuators 630B of the fluid ejectors and by increasing the width of such power ground lines 40; and (2) selectively and/or automatically shorting the power ground lines 36, 40 in response to the power ground line 36 for the fluid pumps being underutilized.

Figure 11:
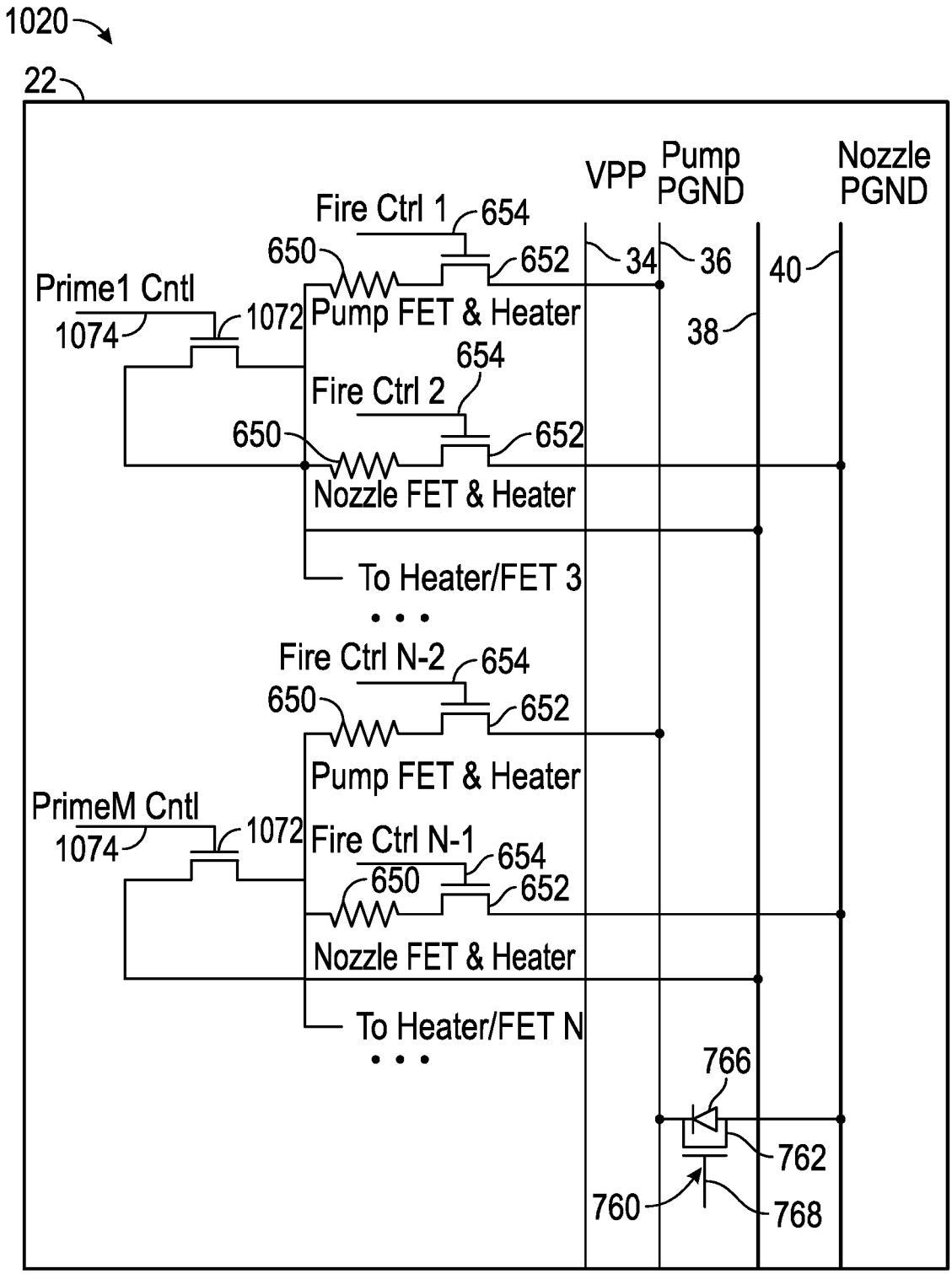
FIG. 11 is a schematic diagram illustrating portions of another example fluidic die.

FIG. 11 schematically illustrates portions of an example fluidic die 1020. Fluidic die 1020 is similar to fluidic die 920 except that fluidic die 1020 actuates fluid actuators 630 using a combination or hybrid of low side switches and high side switches. Similar to fluid actuators 630 of fluidic die 920, fluid actuators 630 of fluidic die 1020 have transistors 652 and are electrically connected between their respective electrically resistive elements 650 and power ground line 36 (for fluid actuators 630A), power ground line 40 (for fluid actuators 630B). However, instead of being directly electrically connected to their respective power supply lines 34, 38, electrically resistive elements 650 are selectively connectable to the respective power supply lines 38 by additional transistors 1072 having gates connected to enablement lines 1074. In the example illustrated in FIG. 11, each enablement line 1074 and each transistor 1072 is assigned to a group of fluid actuators 630 (including fluid actuators that form both pumps and ejectors) that form a primitive. Signals transmitted on a neighbor lines 1074 selectively enable each of the fluid actuators of their respective primitives. Individual fluid actuators in each of primitives are further enabled based upon signals transmitted on the individual fire control lines 654. Enabling signals transmitted on both of the enable line 1074 and the fire control line 654 for an individual fluid actuator of the enabled primitive result in the individual fluid actuator being actuated at a given firing instance.

Although die 1020 is illustrated as comprising shorting switch 760, in other implementations, die 1020 may comprise shorting switch 860. As with dies 720, 820 and 920, die 1020 provides enhanced performance by: (1) reducing power delivery parasitics for the fluid ejectors which are more sensitive to such parasitics by providing dedicated power ground lines 40 for the fluid actuators 630B of the fluid ejectors and by increasing the width of such power ground lines 40; and (2) selectively and/or automatically shorting the power ground lines 36, 40 in response to the power ground line 36 for the fluid pumps being underutilized.

Although each of the examples illustrated in FIGS. 7-11 described the use of dedicated power lines 34, 36, 38 and 40 for fluid actuators that form fluid ejectors and fluid pumps, wherein performance of the fluidic dies is more sensitive to power delivery parasitics experienced by the fluid actuators that form the fluid ejectors, in other implementations, the dedicated power lines as well as the selective or automatic electrical shorting described above may be carried out with respect to other combinations of fluid actuators. For example, in one implementation, the fluid actuators of the array 624 may have actuators that are similar to one another except that the actuators of the different sets displace different fluids. For example, in one implementation, a first set of fluid actuators may form fluid ejectors for a first type of ink, such as a yellow ink, while the other set of fluid actors may form fluid ejectors for a second type of ink having a different color such as cyan, magenta or black ink. In such an implementation, print quality or image quality may be less sensitive to variations in the ejection of yellow ink as compared to the ejection of other colors of ink. In such an implementation, those fluid actuators that form ejectors for ejecting yellow ink may be provided with narrower power lines (power supply and/or power ground lines) as compared to those fluid actuators that form ejectors for ejecting other colors of ink.

In some implementations, the different sets of fluid actuators themselves may have different characteristics that serve as a basis for varying the characteristics of the power lines connected to the different sets of fluid actuators. For example, in one implementation, a first set of fluid actuators may form fluid ejectors for ejecting a first drop weight of fluid while the second set of fluid actuators may form fluid ejectors for ejecting a second drop weight of fluid, wherein print quality or image quality may be more sensitive to variations in the ejection of fluid at a smaller drop weight as compared to the ejection of fluid at a larger drop weight. In such an implementation, those fluid actuators that form ejectors for ejecting the smaller drop weight may be provided with wider power lines as compared to those fluid actuators that form ejectors for ejecting larger drop weights.

Figure 12:
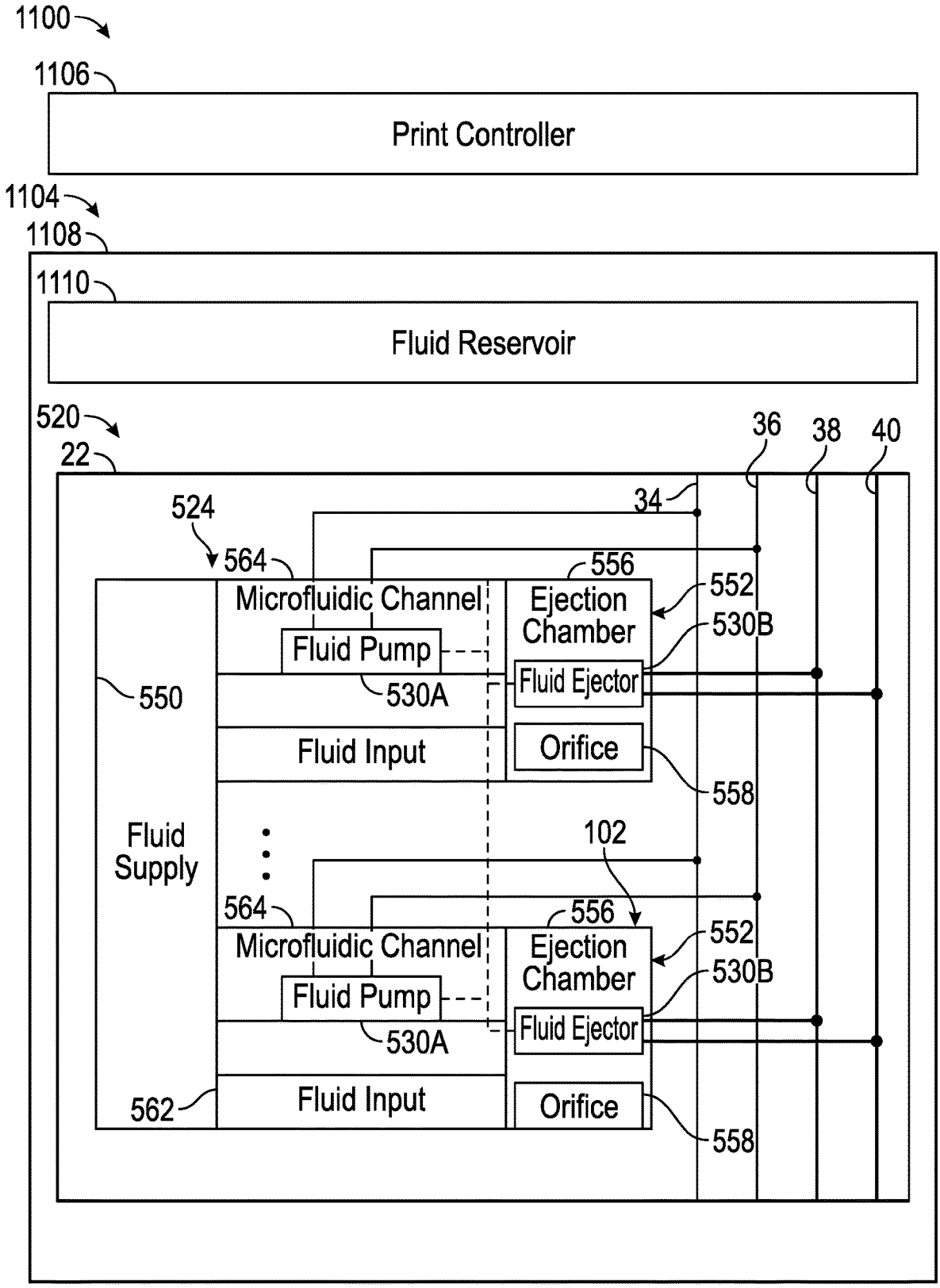
FIG. 12 is a schematic diagram illustrating portions of an example fluid ejection system.

FIG. 12 is a schematic diagram illustrating portions of an example fluid ejection system 1100. System 1100 is to selectively eject fluid. System 1100 comprises fluid ejection device 1104 and print controller 1106. Fluid ejection device 1104 carries out the ejection of fluid in response to control signals from print controller 1106. Fluid ejection device 1104 comprises housing 1108, fluid reservoir 1110 and system/fluid ejection die 520.

Housing 1108 comprises an enclosure, frame or other structure supporting fluid ejection die 520 (described above)

and fluid reservoir 1110. In some implementations, housing 1108 may additionally enclose and support print controller 1106.

Fluid reservoir 1110 comprises an internal volume formed within the body of housing 1108 for containing a fluid to be ejected by fluid actuators 530B on fluid ejection die 520. Fluid reservoir 1110 is fluidically connected to fluid supply 550.

Print controller 1106 comprises a processing unit and associated non-transitory memory containing instructions for the operation of fluid ejection device 1104. Print controller 1106, following such instructions, outputs control signals control the actuation of fluid actuators 530B to selectively eject fluid. In the example illustrated, print controller 1106 is located remote from fluid ejection die 520 and remote from housing 1108. In other implementations, print controller 1106 may be located separate from fluidic die 520, but within housing 1108. In other implementations, controller 1106 may be located on fluid ejection die 520.

In one implementation, fluid ejection device 1104 may comprise a print cartridge. Each of the fluid actuators 530 on fluid ejection die 520 are supplied with ink or other printing fluid from a self-contained fluid reservoir 1110. In yet another implementation, fluid reservoir 1110 may be replenished with ink or fluid from a fluid supply separate from the print cartridge formed by fluid ejection device 1104. In such an implementation, fluid reservoir 1110 may contain ink, toner, varnish, gloss, fixing agents and the like. In some implementations, fluidic die 520 may form a fluid ejection die in the form of a printhead.

Figure 13:
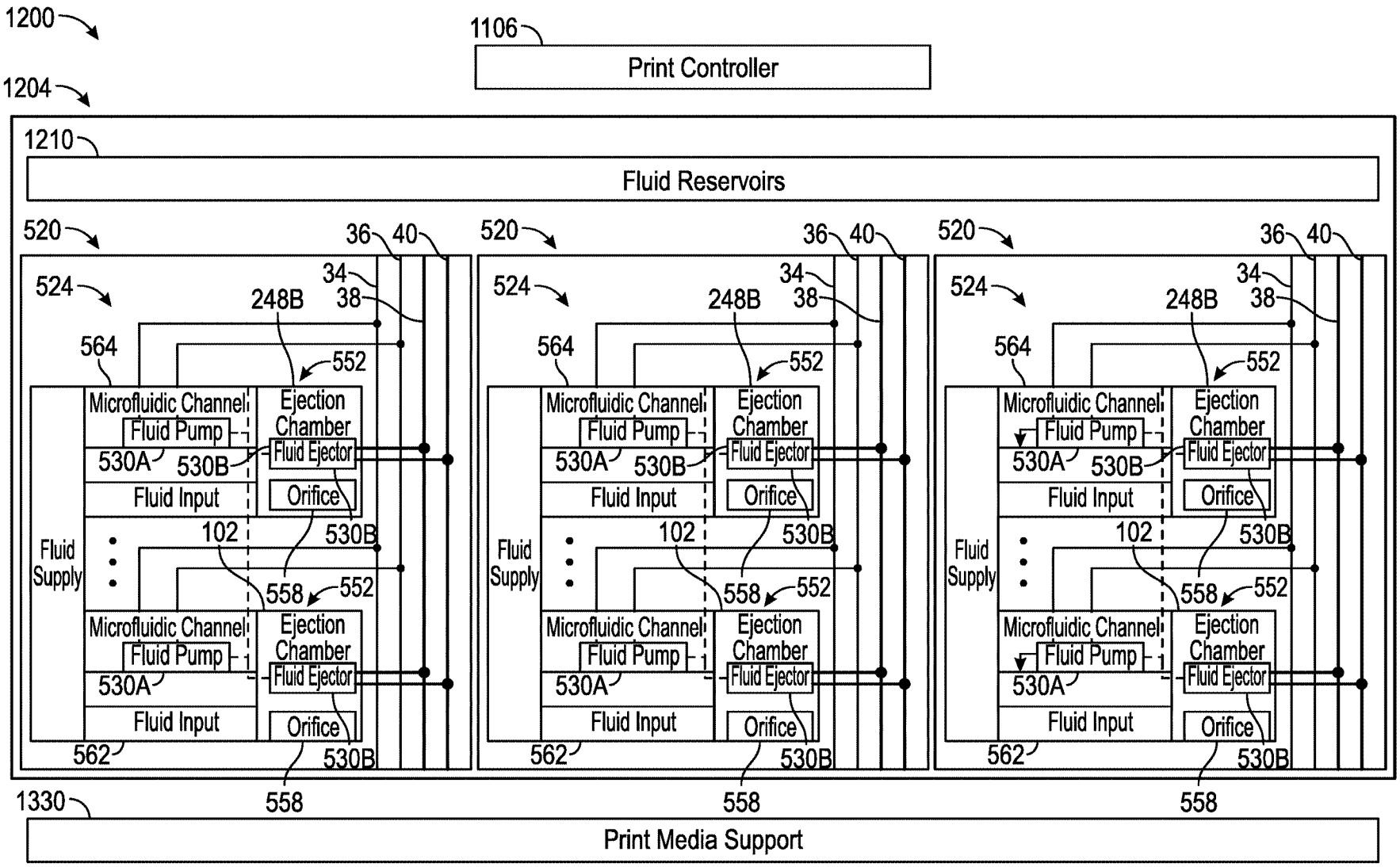
FIG. 13 is a schematic diagram illustrating portions of an example fluid ejection system.

FIG. 13 schematically illustrates portions of an example fluid ejection system 1200. Fluid ejection system 1200 is similar to fluid ejection system 1100 except that fluid ejection system 1200 comprises fluid ejection device 1204 which comprises a plurality of systems/fluid ejection dies 520 supported by housing 1108. In one implementation, fluid ejection device 1204 comprises a sufficient number of fluid ejection dies 520 so as to span and completely extend across and opposite to print media support 1330 which positions print media, such as sheets of paper, opposite to fluid ejection device 1204. In such an implementation, fluid ejection device 1204 may comprise what may be referred to as a page-wide print bar or page-wide fluid ejection device. In some implementations, fluid ejection device 1204 may comprise a plurality of fluid reservoirs 1210 which supplied different types of fluid to the different fluidic dies.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example. The four-line case would inherently include the claimed three lines. Implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A fluidic die comprising:

an array of fluid actuators comprising a first set of fluid actuators having a first sensitivity to current and voltage variations and a second set of fluid actuators having a second sensitivity to current and voltage variations, the second sensitivity being different than the first sensitivity;

a first power line connected to the first set of fluid actuators, the first power line having a first power transmission parasitic characteristic;

a second power line connected to the second set of fluid actuators, the second power line having a second power transmission parasitic characteristic different than the first power transmission parasitic characteristic; and a third power line connected to the first set of fluid actuators.

2. The fluidic die of claim 1, wherein the first power line and the second power line comprise a first power supply line and a second power supply line, respectively, and wherein the third power supply line comprises a power ground line.

3. The fluidic die of claim 2 further comprising at least one of a diode and electrical switch electrically connected between the first power supply line and the second power supply line.

4. The fluidic die of claim 2 further comprising a fourth power line comprising a second power ground line, wherein the power ground line is connected to the fluid actuators of the first set and the second power ground line is connected to the fluid actuators of the second set.

5. The fluidic die of claim 4 further comprising a diode electrically connected between the first power supply line and the second power supply line.

6. The fluidic die of claim 5 further comprising an electrical switch electrically connected between the power ground line and the second power ground line.

7. The fluidic die of claim 6 further comprising a second diode electrically connected between the power ground line and the second power ground line.

8. The fluidic die of claim 5 further comprising an electrical switch electrically connected between the first power supply line and the second power supply line.

9. The fluidic die of claim 8 further comprising a second electrical switch connected between the power ground line and the second power ground line.

10. The fluidic die of claim 1, wherein the first power line and the second power line comprise a first power ground line and a second power ground line, respectively, and wherein the third power supply line comprises a power supply line.

11. The fluidic die of claim 10 further comprising at least one of a diode and electrical switch electrically connected between the first power ground line and the second power ground line.

12. The fluidic die of claim 1, wherein the first set of fluid actuators form fluid pumps and wherein the second set of fluid actuators form fluid ejectors.

13. The fluidic die of claim 1, wherein the first set of fluid actuators each have a first drop weight and wherein the second set of fluid actuators each have a second drop weight different than the first drop weight.

14. The fluidic die of claim 1, the first set of fluid actuators each have a first drop weight, wherein the second set of fluid actuators each have a second drop weight greater than the first drop weight, wherein the first power line has a first width and wherein the second power line has a second width greater than the first width.

15. The fluidic die of claim 1, wherein the first set of fluid actuators form fluid ejectors for ejecting a first fluid and wherein the second set of fluid actuators form fluid ejectors for ejecting a second fluid having a characteristic different than the first fluid.

16. The fluidic die of claim 1, wherein the first set of fluid actuators form fluid ejectors for ejecting a first color of ink and wherein the second set of fluid actuators form fluid ejectors for ejecting a second color of ink.

17. The fluidic die of claim 1, wherein the first set of fluid actuators forms a first primitive and wherein the second set of fluid actuators forms a second primitive.

18. A fluidic die comprising:

an array of fluid actuators comprising a first set of fluid actuators and a second set of fluid actuators;

a first power line comprising one of a power supply line type and a power ground line type, the first power line being connected to the first set of fluid actuators;

a second power line comprising said one of the power supply line type and the power ground line type, the second power line being connected to the second set of fluid actuators;

a third power line connected to the first set of fluid actuators; and at least one of a diode and electrical switch electrically connected between the first power line and the second power line.

19. A fluidic die comprising:

an array of fluid ejectors and fluid pumps, each of the fluid ejectors and the fluid pumps comprising a fluid actuator;

a first power supply line connected to the fluid actuator of each of the fluid ejectors of the array;

a second power supply line connected to the fluid actuator of each of the fluid pumps of the array, the first power supply line and the second power supply line combining outside of the array;

a first power ground line connected to each of the fluid actuators of the fluid ejectors of the array;

a second power ground line connected to each of the fluid actuators of the fluid pumps of the array, the first power ground line in the second power ground line combining outside of the array; and a diode electrically connected between the first power ground line and the second power ground line.

20. A method comprising:

supplying power to the first set of fluid actuators across a first power supply line dedicated to the first set of fluid actuators;

supplying power to the second set of fluid actuators across a second power supply line dedicated to the second fluid actuators;

returning electrical current from the first set of fluid actuators across a first power ground line dedicated to the first set of fluid actuators;

returning electrical current from the second set of fluid actuators across a second power ground line dedicated to the second set of fluid actuators; and electrically connecting the first power ground line to the second power ground line based upon a relative extent to which the first set of fluid actuators and the second set of fluid actuators are being actuated.

* * * * *